US006793212B2

(12) United States Patent
Holbrook

(10) Patent No.: US 6,793,212 B2
(45) Date of Patent: Sep. 21, 2004

(54) ON-EDGE ENVELOPE STACKER ADJUSTABLE FOR DIFFERENT SIZED ARTICLES

(75) Inventor: Russell W. Holbrook, Southbury, CT (US)

(73) Assignee: PitneyBowes Inc., Stamford, CT (US)

( * ) Notice: Subject to any disclaimer, the term of this patent is extended or adjusted under 35 U.S.C. 154(b) by 4 days.

(21) Appl. No.: 10/280,267

(22) Filed: Oct. 24, 2002

(65) Prior Publication Data

US 2004/0080096 A1 Apr. 29, 2004

(51) Int. Cl.[7] ..... B65H 5/00
(52) U.S. Cl. ..... 271/2; 271/185
(58) Field of Search ..... 271/177, 185, 271/200, 207, 2; 198/405, 412

(56) References Cited

U.S. PATENT DOCUMENTS 2,841,394 A * 7/1958 Stobb ..... 271/185
3,729,189 A * 4/1973 Watson ..... 271/65
4,705,157 A * 11/1987 Bowles ..... 198/405
5,029,832 A * 7/1991 Orsinger et al. ..... 270/58.06
5,211,384 A * 5/1993 Orsinger et al. ..... 270/59
5,368,287 A * 11/1994 Belec et al. ..... 271/185
5,411,250 A * 5/1995 Belec et al. ..... 271/185
6,398,204 B1 * 6/2002 Keane et al. ..... 271/2
6,623,002 B1 * 9/2003 Auerbach ..... 271/223

* cited by examiner

*Primary Examiner*—David H Bollinger
(74) *Attorney, Agent, or Firm*—Michael J. Cummings; Charles R. Malandra, Jr.; Angelo N. Chaclas

(57) ABSTRACT

A stacking apparatus (10) for stacking flat articles (12) on edge is provided, including a belt turn-up apparatus (20) for receiving the articles at an entry nip (26*a*) in a flat position and providing them to a discharge magazine (40) in an on-edge position, the belt turn-up apparatus (20) including a housing (20*b*) contained within an exterior frame (20*a*) and rotatable about a shaft (20*c*) near the entry nip (26*a*) via a screw adjustment (20*d*) at the egress end of the housing (20*b*), i.e. adjacent the discharge magazine (40), and so allowing an adjustment of the stacking apparatus (10) to compensate for different sizes of envelopes (12).

5 Claims, 4 Drawing Sheets

ON-EDGE ENVELOPE STACKER ADJUSTABLE FOR DIFFERENT SIZED ARTICLES

BACKGROUND OF THE INVENTION

1. Technical Field

This invention relates generally to mass mail handling equipment. More particularly, this invention relates to an improved apparatus for taking a series of flat articles such as envelopes, orienting them, and then stacking the articles in groupings.

2. Description of Related Art

In the high volume mail industry, in both U.S. First Class and Third Class mail, envelopes are filled with various letter pieces using automated mail inserters. For example, U.S. Pat. No. 5,029,832 and U.S. Pat. No. 5,211,384 disclose an in-line inserter device having envelope and feeding assemblies, an envelope inserting station, a sealing and stacking assembly, and various diverter stations.

Mass-mailing equipment has become very diverse in its functions. For instance, inserting equipment transport envelopes along an inserting track while various types of inserts are automatically inserted into the envelopes. The envelopes are normally transported to another piece of equipment that automatically seals the envelopes, weighs them and affixes postage. Still additional equipment automatically reads the zip codes or zip code indicia on the envelopes and indicates zip code breaks in the envelope groups or zip code pre sorting. This allows the user to take advantage of lower postage rates. Other mass-mailing equipment may include remittance processing equipment and zip code sorting equipment.

Customers utilizing mass-mailing equipment may have differing needs and requirements. Therefore, mass-mailing equipment is generally designed for one specific function. Each piece can then be connected by conveyor or other transport means to additional mail processing equipment so that a customized system can be assembled. One problem with this approach is that adjacent mail processing equipment may require the envelopes to be oriented in a position which is different from the discharge device of the preceding equipment. This necessitates transition conveyors or re-orientation devices.

For example, most mail processing inserting equipment in use today move the envelopes along a track with their faces (the addresses) face down and the flaps extended with the back of the flaps up during the insertion mode. The envelopes, as they leave the inserting machine, may have the flaps moistened and sealed before exiting the inserting machine. If the envelope is then going to have postage applied, it must be turned over 180 degrees so that the postage can be affixed to the face of the envelope. Other operations may require the envelope to be turned 90 degrees.

Currently, many inserters simply eject the filled envelope onto a short flat conveyor, allowing the envelopes to free float on the conveyor. This causes the possibility that the zip order of the envelopes will get mixed up, the possibility of envelopes becoming disorderly and difficult to quickly pick up, and the possibility of envelope flaps popping open prior to proper glue drying. Additionally, this method is an inefficient use of conveyor space, allowing only a short amount of time before the conveyor becomes full. This requires the increased attention from an operator. Often, an operator is forced to shut down the entire machine to catch up with the emptying of the conveyor. Obviously, doing so drastically reduces the overall throughput of envelopes.

These mail inserters may run at high speeds, up to thousands of envelopes per hour. Such speeds have created a need on the end of the inserters to collect the filled envelopes in such a way as to allow the operator to load them into mail trays or other forms of storage quickly and efficiently.

This area has proven to be a bottleneck of the mail insertion process. Many times, the operator has a difficult time keeping up with the inserter. To address the bottleneck, an envelope stacking apparatus is sometimes provided at the end of the system to secure the sorted mail pieces in a stacked position, facilitating the orderly removal of the processed mail pieces from the system.

One such stacking apparatus is disclosed in U.S. Pat. No. 4,705,157. Here, a device is disclosed for turning envelopes 90 degrees as the envelopes are moved forward through the device from an entrance location to an exit location using two endless belts adjacent to one another. The envelopes are ultimately stacked once they leave the exit location.

U.S. Pat. No. 6,398,204 provides an on-edge stacking apparatus that accepts envelopes in a flat condition, reorients them 90 degrees to an on-edge position, and stacks them in a tray, keeping the envelopes in order. The on-edge stacking apparatus provided by this patent is a tolerable solution in cases where the envelopes to be stacked are always of the same size. But in cases where the envelope size changes, an operator must reposition the on-edge stacking apparatus relative to the envelope feed tray (which is attached not to the stacking apparatus but to upstream equipment) because the envelopes are fed to the stacking apparatus from the feed tray top-edge justified to a register (backstop) of the feed tray, and so without repositioning, when larger envelopes arrive at the feed tray and are then rotated inside the stacking apparatus before being stacked on-edge in the output tray, the bottom of the larger envelopes protrudes down below the floor of the output tray. A solution to this problem is to interpose a bottom-edge aligner so that envelopes are input to the stacking apparatus bottom-edge aligned/justified, but such equipment can be expensive and consumes space, very often a scarce resource.

What is needed is an on-edge stacking apparatus that requires neither an interposed bottom-edge aligner, or having an operator manually adjust the position of the stacking apparatus relative to the input/feed tray to compensate for different sized envelopes.

SUMMARY OF THE INVENTION

Accordingly, in a first aspect of the invention, a stacking apparatus is provided, comprising: a belt-turn up mechanism having an entry nip and an egress nip, for receiving a plurality of articles arriving successively at the entry nip in a flat orientation, for rotating the articles from flat to on-edge, and for providing the articles successively on edge at the egress nip; and a discharge magazine, disposed adjacent the egress nip, for receiving successively each article provided on edge, and for stacking the articles on edge; wherein the belt turn-up mechanism comprises means for pivoting the egress nip substantially about the entry nip, thereby allowing adjustment of the stacking apparatus for different sized articles.

In accord with the first aspect of the invention, the belt turn-up mechanism may include two belts and four pulleys, of which two pulleys form the entry nip and two pulleys form the egress nip.

Also in accord with the first aspect of the invention, the means for pivoting the egress nip substantially about the entry nip may be a screw adjustment.

Still also in accord with the first aspect of the invention, the stacking apparatus may also include: a sensor for sensing the size of a next article at the entry nip and for providing a sizing signal conveying information about the size of the next article; a controller, responsive to the sizing signal, for providing an adjusting signal based on the sizing signal; and a motor, responsive to the adjusting signal, for providing a force for pivoting the egress nip substantially about the entry nip.

In a second aspect of the invention, a method of operation of a stacking apparatus, comprising: a step of receiving a plurality of articles arriving successively at an entry nip in a flat orientation, rotating the articles from flat to on-edge, and providing the articles successively on edge at an egress nip; a step of receiving successively each article provided on edge, and for ejecting the articles at an egress nip so as to stack the articles on edge; and a step of pivoting the egress nip substantially about the entry nip as needed to allow adjust for different sized articles.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

BEST MODE FOR CARRYING OUT THE INVENTION

Figure 1:
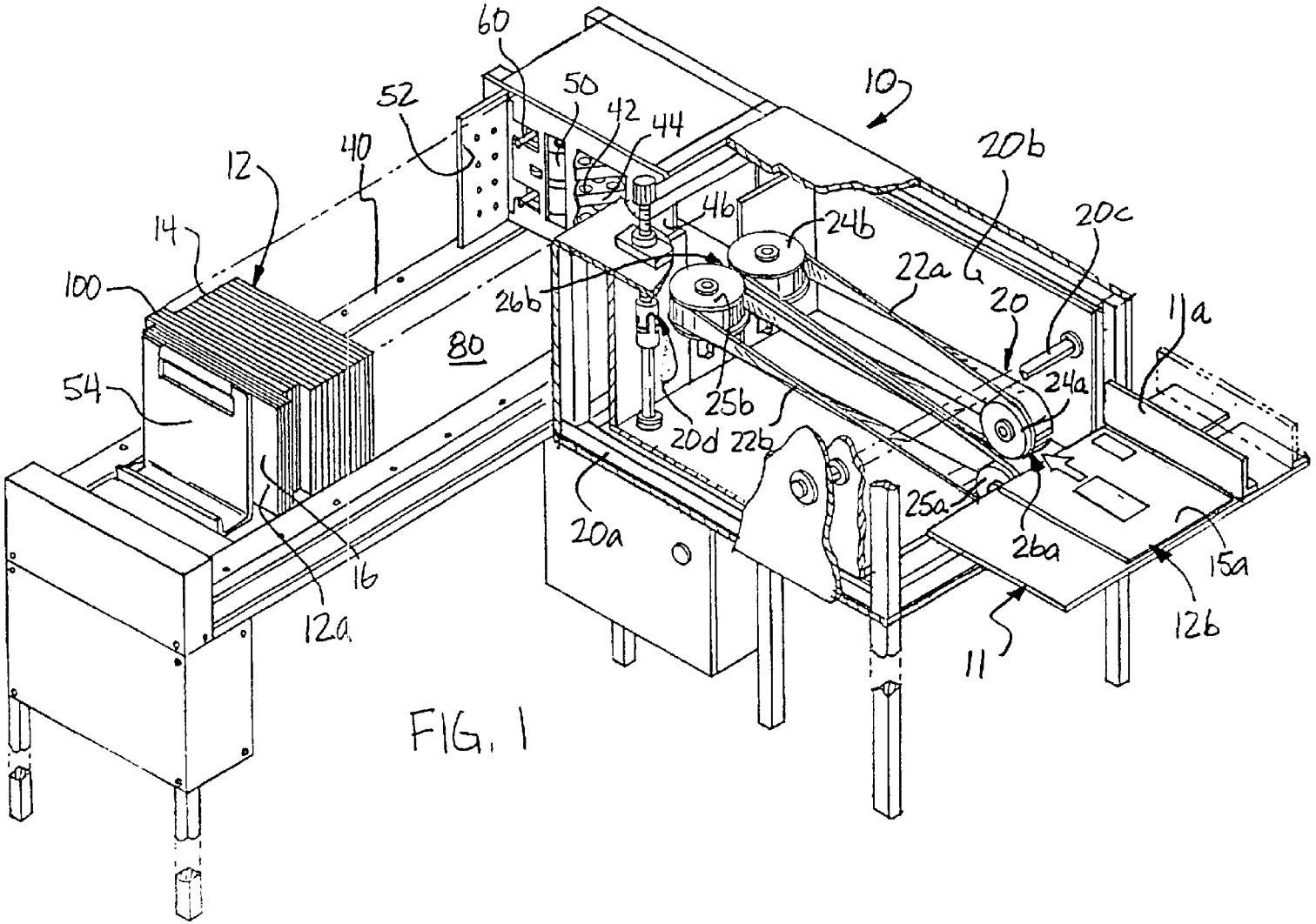
FIG. 1 is an isometric view of an on-edge stacking apparatus in accordance with one preferred embodiment of the present invention.

Referring now to FIG. 1, an on-edge stacking apparatus 10, for stacking articles such as envelopes, is shown in accordance with one preferred embodiment of the present invention as comprising: a belt turn-up mechanism 20, a discharge magazine 40, an article stack offsetting means 60, and an article stack conveyor 80. Each of these components may operate individually, or in combination with the other components of the system. The on-edge stacking apparatus 10 receives a folded-close (and usually sealed) envelope 12*b* (or other kinds of articles to be stacked), following a first envelope 12*a* in a series of envelopes 12. The envelope is received from an entry tray 11 after being conveyed (by a conveyor not shown) to the back of the entry tray 11 so as to have its top edge 15*a* flush to a top-edge entry register 11*a*, from which position the envelope is urged (by a mechanism not shown) toward an entry nip 26*a*, which ingests the envelope, leading edge 15*b* first, in a flat (usually face up) position, into the belt-turn up mechanism 20.

Figure 2:
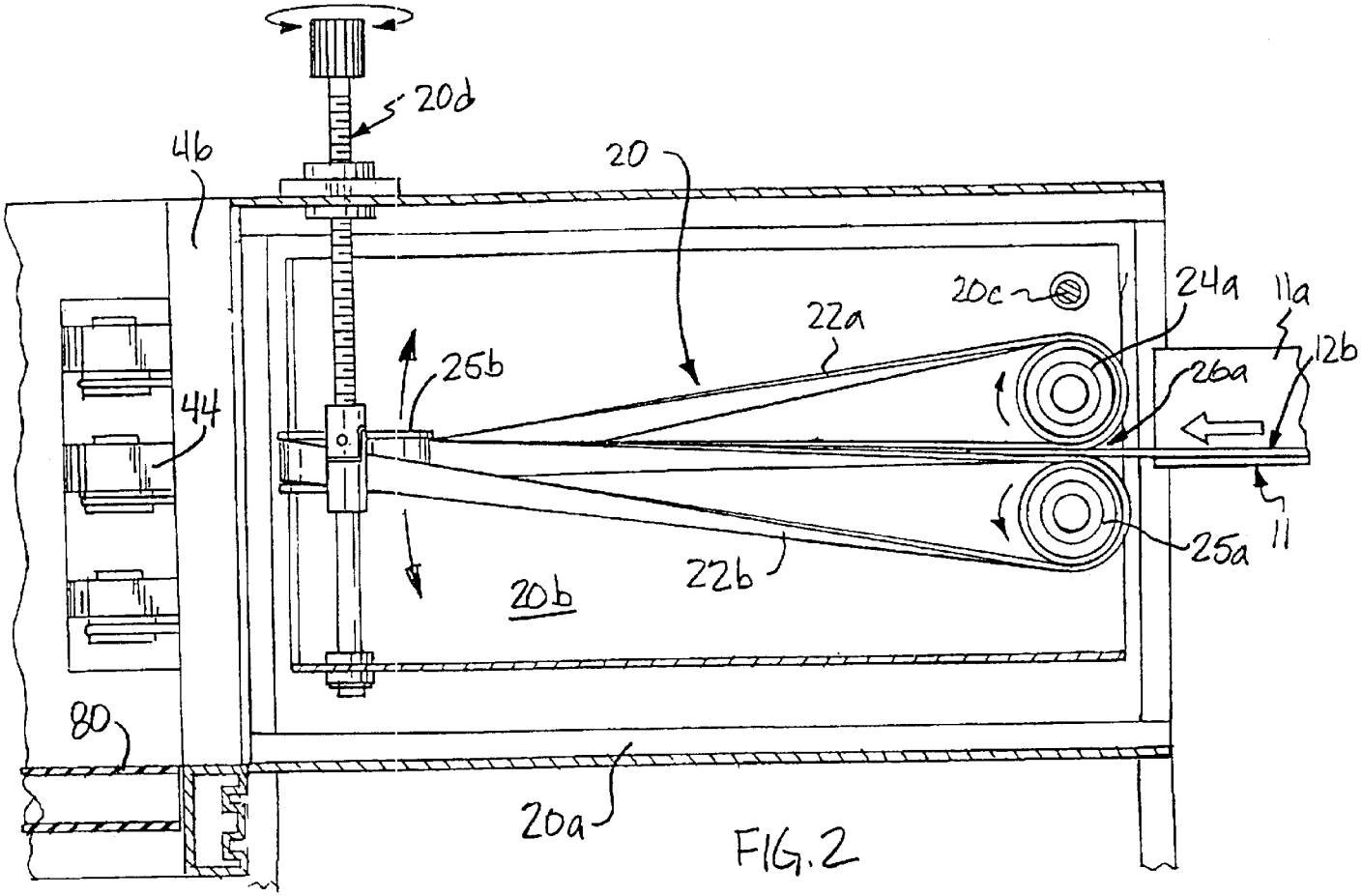
FIG. 2 is a top view of a belt turn-up mechanism as used in the on-edge stacking apparatus of FIG. 1.

As can be seen in FIGS. 1 and 2, the on-edge stacking apparatus 10 of the present invention uses the belt turn-up mechanism 20 to turn a generally flat article, such as the envelope 12*b*, from flat (at the point of entry at entry nip 26*a* of the belt turn-up mechanism) to on-edge (in the discharge magazine 40). The design of the belt turn-up apparatus uses two belts 22*a* 22*b* and four pulleys 24*a* 24*b* 25*a* 25*b*, whereas the belt turn-up apparatus disclosed in U.S. Pat. No. 6,398,204 uses two belts and six pulleys.

Figure 3:
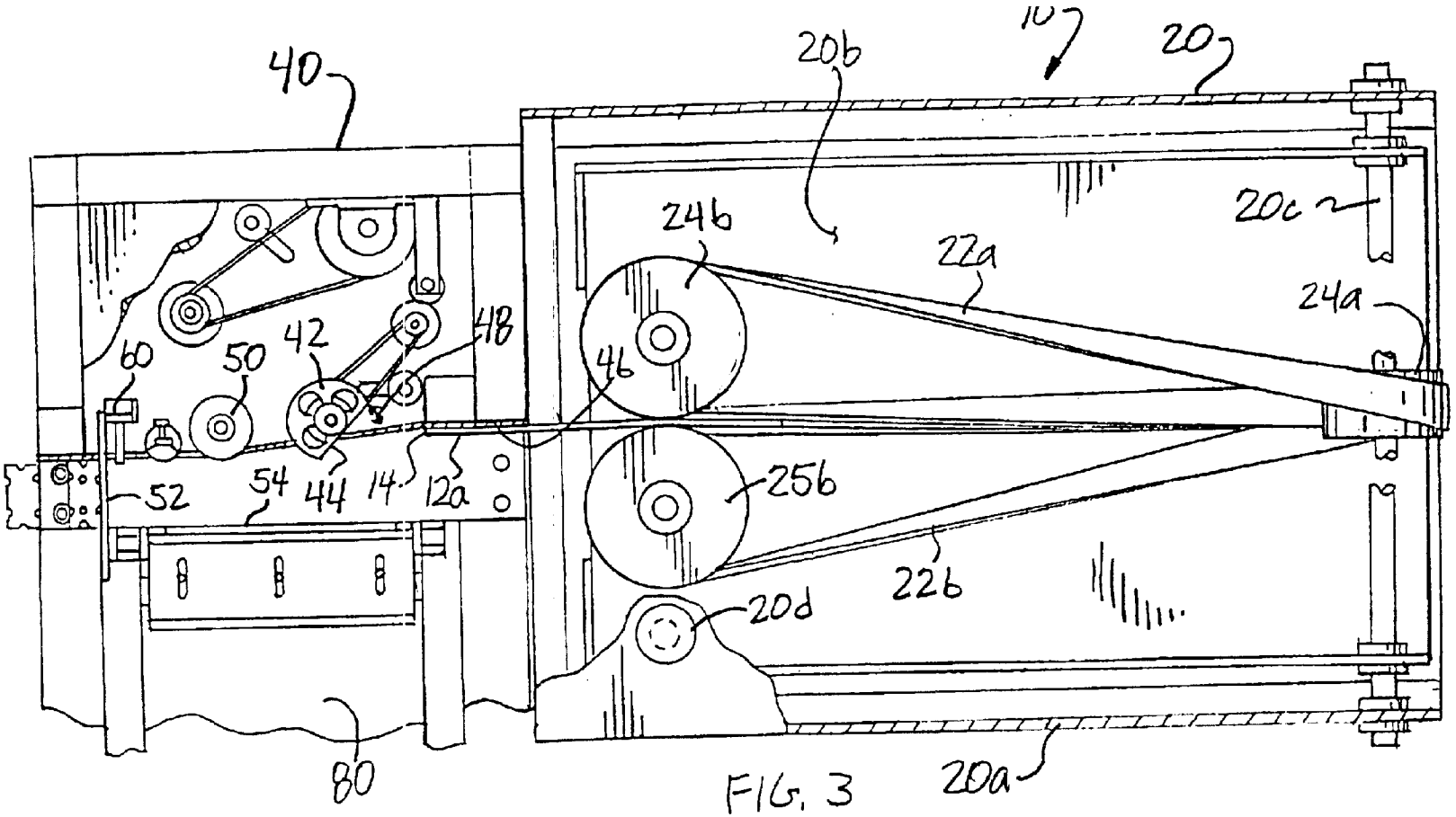
FIG. 3 is a partial top view of the on-edge stacking apparatus of FIG. 1 depicted without an envelope stack.
Figure 4:
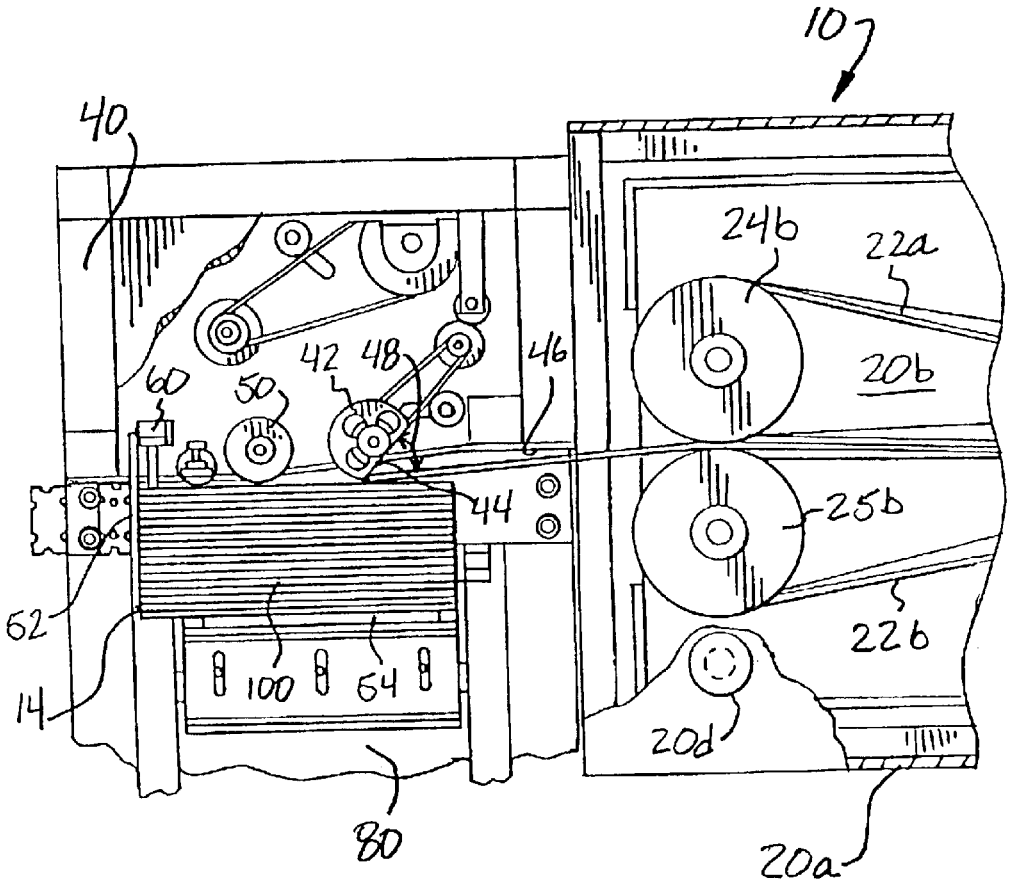
FIG. 4 is a partial top view of the on-edge stacking apparatus of FIG. 1. Depicted with an envelope stack and a single envelope entering the envelope stack with a segmented roller in its home position and an envelope engaging the segmented roller.

As can best be seen in FIGS. 3–4, once the envelope 12*b* is on edge, the envelope is transferred through the discharge magazine 40 onto the conveyor 80, usually about 6 to 8 feet long, and inserted into the rear of an envelope stack 100.

It must be appreciated that if the entry tray 11 with top-edge entry register 11*a* is disposed relative to the entry nip 26*a* for an envelope of a first size, and then a second, larger envelope arrives at the entry tray 11, larger in size from top to bottom (as opposed to in width), since both sized envelopes are ingested with their top edges at the same location relative to the stacking apparatus 10, when the larger envelope is rotated 90 degrees in the belt turn-up mechanism 20 (from flat to on-edge), the bottom edge of the larger envelope will protrude lower than the bottom edge of the smaller envelope, and so might crash into the floor of the discharge magazine 40 as it is ejected from the belt turn-up mechanism 20, unless the egress nip 26*b*, at the distal end of the belt turn-up mechanism (i.e. opposite from the end with the entry nip 26*a*), is raised up, relative to the floor of the discharge magazine, to make room, and so to compensate for the larger sized envelope. To provide for raising (and lowering) the egress nip 26*b*, the invention provides that the belt turn-up mechanism includes: an exterior frame 20*a*; a housing 20*b* for housing the entry nip 26*a* and the egress nip 26*b* (i.e. for housing the pulleys 24*a* 24*b* 25*a* 25*b* and belts 22*a* 22*b* that make up the nips 26*a* 26*b*), the housing contained within the exterior frame; a shaft 20*c* attached to the exterior frame of the belt turn-up mechanism 20 and rotatably piercing the housing 20*b* at the entry-nip end of the housing, so that the housing is rotatable (or pivotable), within the exterior frame, about the shaft; and finally a screw adjustment 20*d* rotatably attached to the housing 20*b* and protruding below the housing to the floor of the exterior frame 20*a* of the belt turn-up mechanism, and also protruding above the housing so as to be turnable from a position above the housing, and so that when turned, the screw adjustment protrudes more or less from the bottom of the housing and so raises or lowers the distal end of the housing (relative to the exterior frame of the belt turn-up mechanism, i.e. the screw adjustment causes the distal end to rotate or pivot about the shaft at the entry nip end of the housing), thus allowing raising or lowering the egress nip 26*b* to compensate for a change in size of the envelopes being ingested at the entry nip 26*a*.

The invention comprehends other adjustment mechanisms besides the screw adjustment 20*d*, such as mechanisms based on electrostatic control, or magnetism (including magnetic levitation techniques), or other mechanical mechanisms, including hydraulic mechanisms.

Referring again to FIG. 1, in some applications, it is preferable to have the screw adjustment 20*d* (or other adjustment mechanism) operated manually, but in others it is preferable (worth the extra expense and complexity) to have the screw adjustment operated automatically. For automatic adjustment, as shown in FIG. 1, a sensor 200 is placed at the entry nip 26*a* or upstream of the entry nip (in the entry tray 11 or even further upstream) for sensing the size (from top to bottom) of the incoming envelope and conveying the size information as a sizing signal to a controller 210, situated preferably at the distal end of the belt turn-up mechanism 20, for controlling a motor 220 (preferably a stepper motor) that responds by applying a force to turn the screw adjustment 20*d* so as to either raise of lower the distal end of the housing 20*b* (and so the egress nip 26*b*), depending on the sizing signal.

In further illustration of the operation of the on edge stacking apparatus 10, referring again to FIGS. 3–4, the discharge magazine 40 takes a series of on-edge envelopes 12 and aligns them to be stacked, using a segmented roller 42 in which a segment is removed providing a flat, planar surface 44 perpendicular to the longitudinal axis of the segmented roller 42 on the otherwise generally cylindrical segmented roller 42. As can be seen in FIG. 4 where a first envelope 12*a* is entering the discharge magazine 40, as the envelope 12*a* enters the article inlet 46 of the discharge magazine 40, the segmented roller 42, stationary in its home position, maintains a gap 48 (FIG. 4) for the first envelope 12*a* to enter. As soon as the first incoming envelope 12*a* (and each successive incoming envelope 12), approaches the segmented roller 42 and enters the gap 48, the segmented roller 42 indexes 360 degrees and then stops to assist in driving the first envelope 12*a* to start the horizontal stack 100 and then stacks each succeeding envelope 12 behind the first envelope 12*a* into the stack 100, with its leading edge flush to a register wall 52.

In addition to the segmented roller, there is optionally a second continuously rotating roller 50 which is an assist drive roller that runs continuously and ensures that the incoming envelope is driven to an article edge receiving means, preferably in the form of the register wall 52, where the front perimeter or leading edges 14 of envelopes 12 are aligned for stacking.

As indicated above, after rotating the 360 degrees, the segmented roller 42 stops and holds in its home position, awaiting the next envelope 12. As can be seen particularly clearly in FIG. 1, a face 16 of the first envelope 12*a* entering to form the stack 100 mates with an article face receiving means 54 in the form of a movable upright support member provided to hold the first envelope 12*a* and the succeeding envelopes 12 upright in an on-edge position. As each successive envelope 12 enters the stack 100 and the stack 100 increases in size, the article face receiving means 54 may be incrementally moved along a conveyor 80, either manually or as described below, to allow additional room for a large stack 100 of envelopes 12, possibly with offsets created by offsetting mechanism 60 (a cylinder having an electronically controlled shaft moveable in a longitudinal direction, operative according to information scanned on incoming envelopes, for offsetting the envelopes in the discharge magazine 40 so as to make easily identifiable breaks based e.g. on zip code changes).

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A stacking apparatus, comprising:

a belt-turn up mechanism having at least two belts and having an entry nip and an egress nip, for receiving a plurality of articles arriving successively at the entry nip in a flat orientation, the mechanism arranged to rotate the articles between the at least two belts from flat to on-edge, and to provide the articles successively on edge at the egress nip; and a discharge magazine, disposed adjacent the egress nip, for receiving successively each article provided on edge, and for stacking the articles on edge;

wherein the belt turn-up mechanism comprises means for pivoting the egress nip substantially about the entry nip, thereby allowing adjustment of the stacking apparatus for different sized articles.

2. The stacking apparatus of claim 1, wherein the belt turn-up mechanism includes two belts and four pulleys, of which two pulleys form the entry nip and two pulleys form the egress nip.

3. The stacking apparatus of claim 1, wherein the means for pivoting the egress nip substantially about the entry nip is a screw adjustment.

4. The stacking apparatus of claim 1, further comprising:

a sensor for sensing the size of a next article at the entry nip and for providing a sizing signal conveying information about the size of the next article;

a controller, responsive to the sizing signal, for providing an adjusting signal based on the sizing signal; and a motor, responsive to the adjusting signal, for providing a force for pivoting the egress nip substantially about the entry nip.

5. A method of operation of a stacking apparatus, comprising:

a step of receiving a plurality of articles arriving successively at an entry nip in a flat orientation, rotating the articles from flat to on-edge, and providing the articles successively on edge at an egress nip;

a step of receiving successively each article provided on edge, and for ejecting the articles at an egress nip so as to stack the articles on edge; and a step of pivoting the egress nip substantially about the entry nip as needed to allow adjust for different sized articles.

* * * * *